US011255132B2

(12) United States Patent
Dziekonski

(10) Patent No.: US 11,255,132 B2
(45) Date of Patent: Feb. 22, 2022

(54) SHEARABLE TUBULAR SYSTEM AND METHOD

(71) Applicant: Mitchell Z. Dziekonski, Stafford, TX (US)

(72) Inventor: Mitchell Z. Dziekonski, Stafford, TX (US)

(73) Assignee: Mitchell Z. Dziekonski, Stafford, TX (US)

( * ) Notice: Subject to any disclaimer, the term of this patent is extended or adjusted under 35 U.S.C. 154(b) by 165 days.

(21) Appl. No.: 16/684,256

(22) Filed: Nov. 14, 2019

(65) Prior Publication Data

US 2020/0080387 A1 Mar. 12, 2020

Related U.S. Application Data

(63) Continuation of application No. 15/694,314, filed on Sep. 1, 2017, now Pat. No. 10,480,255.

(60) Provisional application No. 62/394,503, filed on Sep. 14, 2016.

(51) Int. Cl.

| | |
|---|---|
| ***E21B 17/01*** | (2006.01) |
| ***E21B 17/00*** | (2006.01) |
| ***E21B 33/06*** | (2006.01) |
| ***E21B 33/064*** | (2006.01) |

(52) U.S. Cl.

CPC ..... *E21B 17/01* (2013.01); *E21B 17/00* (2013.01); *E21B 33/063* (2013.01); *E21B 33/064* (2013.01)

(58) Field of Classification Search

CPC ..... E21B 17/00; E21B 17/01; E21B 33/063; E21B 33/064

See application file for complete search history.

(56) References Cited

U.S. PATENT DOCUMENTS

| | | | | |
|---|---|---|---|---|
| 3,326,581 | A * | 6/1967 | Wong | E21B 17/042 285/148.11 |
| 4,483,399 | A * | 11/1984 | Colgate | E21B 7/20 166/207 |
| 9,334,697 | B2 * | 5/2016 | Reinas | E21B 17/07 |
| 2011/0226477 | A1 * | 9/2011 | Springett | E21B 33/063 166/298 |
| 2014/0345872 | A1 * | 11/2014 | Zediker | E21B 17/18 166/340 |
| 2015/0285013 | A1 * | 10/2015 | Johnson | E21B 33/06 166/381 |
| 2018/0058195 | A1 * | 3/2018 | Clark | E21B 17/01 |
| 2018/0073304 | A1 * | 3/2018 | Dziekonski | E21B 17/01 |

* cited by examiner

*Primary Examiner* — Aaron L Lembo

(74) *Attorney, Agent, or Firm* — Fletcher Yoder, P.C.

(57) ABSTRACT

A tubular string for a subterranean well comprises a first string that is located in the well and that can access or traverse horizons of interest, such as during drilling, completion, or workover. A second tubular string is assembled above this first tubular string and is selected so that only this second tubular string normally traverses a blow out preventer during periods when there is an elevated risk that the blow out preventer will be actuated. The second tubular string is made of a more easily shearable material than the first tubular string, such as a titanium alloy, an aluminum alloy, or a composite material. A third or further tubular strings may be assembled above the second tubular string, such as in subsea applications.

11 Claims, 6 Drawing Sheets

SHEARABLE TUBULAR SYSTEM AND METHOD

CROSS-REFERENCE TO RELATED APPLICATIONS

This application is a continuation of U.S. patent application Ser. No. 15/694,314, entitled "Shearable Tubular System and Method," filed Sep. 1, 2017, which claims priority from and the benefit of U.S. Provisional Application Ser. No. 62/394,503, entitled "Shearable Tubular System and Method," filed Sep. 14, 2016, which is hereby incorporated by reference in its entirety.

BACKGROUND

The invention relates generally to tubular structures used to access subterranean horizons of interest, such as in subsea environments, and more particularly to tubulars that have sections that are inherently more shearable than other sections so that the entire structure can be severed in case of need.

BRIEF DESCRIPTION

The development of technologies for exploration for and access to minerals in subterranean environments has made tremendous strides over past decades. While wells may be drilled and worked for many different reasons, of particular interest are those used to access petroleum, natural gas, and other fuels. Such wells may be located both on land and at sea. Particular challenges are posed by both environments, and in many cases the sea-based wells are more demanding in terms of design and implementation. Subsea wells tend to be much more costly, both due to the depths of water beneath which the well lies, as well as for the environmental hazards associated with drilling, completion, and extraction in sensitive areas.

In subsea applications, a drilling or other well servicing installation (such as a platform or vessel) is positioned generally over a region of the sea floor, and an tubular structure extends from the installation to the sea floor. Surface equipment is position at the location of the well to facilitate entry of the tubular into the well, and to enable safety responses in case of need. As the well is drilled, a drill bit is rotated to penetrate into the earth, and ultimately to one or more horizons of interest, typically those at which minerals are found or anticipated. The tubular structure not only allows for rotation of the bit, but for injection of mud and other substances, extraction of cuttings, testing and documenting well conditions, and so forth.

One important component of the surface equipment is a blow out preventer (BOP) and its associated systems located near the seabed. In general, such equipment allows for shearing of the tubular structure in case of unwanted conditions in the well. These systems need to be highly reliable, should not interfere with normal operation of the well or tubular, but should be capable of stopping the flow of fluids quickly as the unwanted conditions occur.

One problem that has been seen in such equipment is the inability of the BOP to sever the tubular reliably. The equipment typically includes blades for that purpose which generally face one another and that are quickly displaced towards one another when the device is actuated by large hydraulic rams. With the tubular between the blades, ideally the entire tubular is sheared and severed, ensuring interruption of flow of fluids and containment of pressures. But in some cases the tubulars are not fully severed, and may only be displaced or partially crushed, which can lead to continued flow and unwanted consequences. This is particularly true of large or thick-walled tubulars.

This inability to shear the tubular may be a particular problem in deep wells and during certain periods of drilling or working operation. For example, a landing string may be used in a subsea or offshore operation to set casing or completion equipment. In deeper wells and deeper water, the overall weight of the equipment, including the overall tubular string, may exceed approximately 2 Mlbs. To support this weight the landing string may be made of a strong grade steel with a very thick wall to withstand the expected stresses. However, such strong and thick materials may be even more difficult, or even impossible to shear with the forces available in BOP.

There is a need, therefore, for improvements in the field. While such improvements may be made to the equipment itself, including the blow out preventers, the present techniques focus on adapting the tubular for improved operation.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
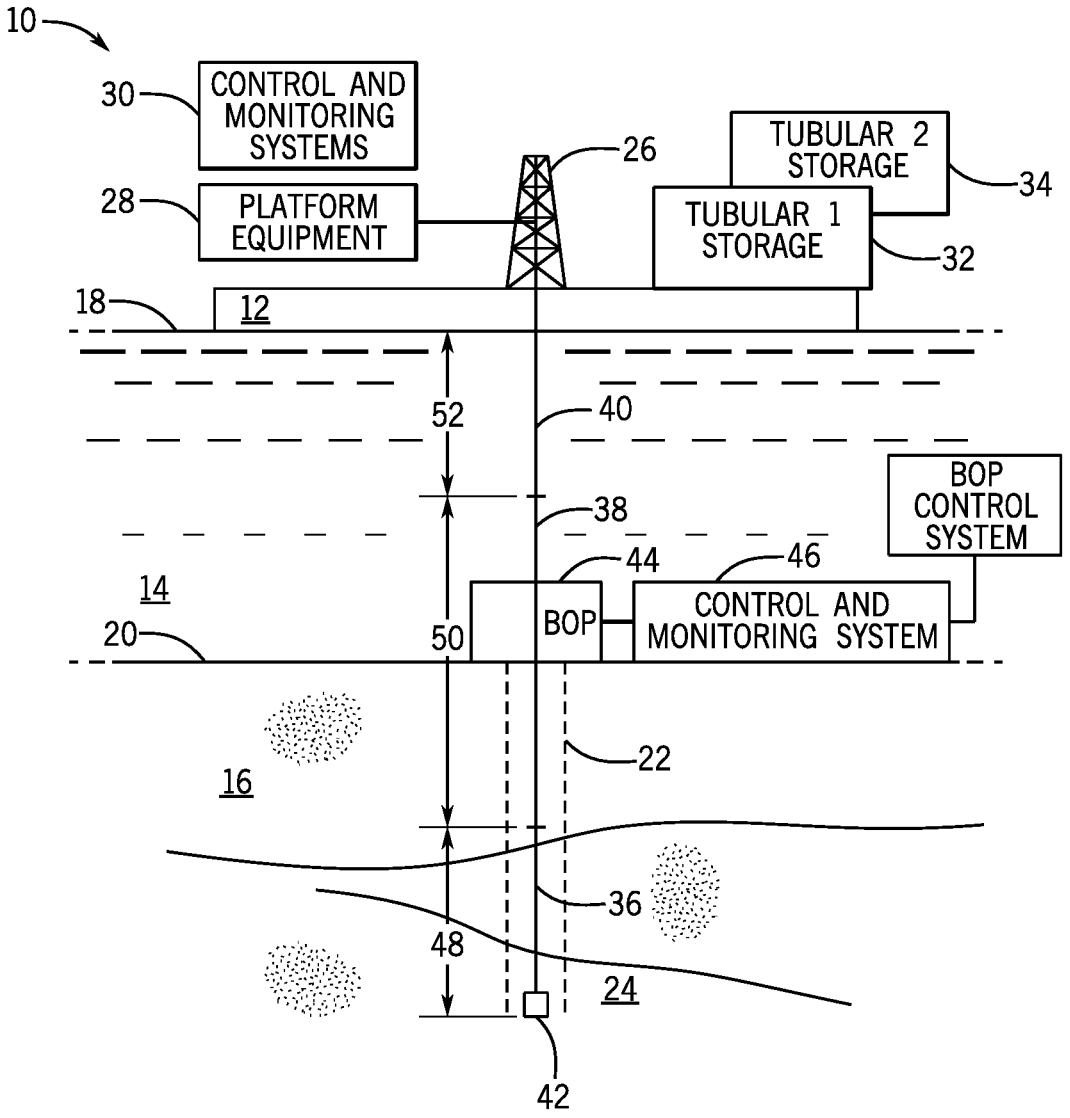
FIG. 1 is a diagrammatical representation of an exemplary installation for drilling, completing, or servicing a subsea well in accordance with the present techniques.

Turning now to the drawings, and referring first to FIG. 1, a well system is illustrated and designated generally by the reference numeral 10. The system is illustrated as an offshore operation comprising a vessel or platform 12 that would be secured to, anchored, moored or dynamically positioned in a stable location in a body of water 14. In FIG. 1, the underlying ground or earth 16 (in this case the seabed) is illustrated below the platform, with the surface of the water designated by the reference numeral 18, and the surface of the earth by reference numeral 20. The platform will typically be positioned near or over one or more wells 22. One or more subterranean horizons of interest 24 will be penetrated or traversed by the well, such as for probing, extraction, accessing or otherwise servicing, depending upon the purpose of the well. In many applications, the horizons will hold minerals that will ultimately be produced form the well, such as oil and/or gas. The platform may be used for any operation on the well, such as drilling, completion, workover, and so forth. In many operations the installation may be temporarily located at the well site, and additional components may be provided, such as for various equipment, housing, docking of supply vessels, and so forth (not shown).

In the simplified illustration of FIG. 1, equipment is very generally shown, but it will be understood by those skilled in the art that this equipment is conventional and is found in some form in all such operations. For example, a derrick 26 allows for various tools, instruments and tubular strings to be assembled and lowered into the well, traversing both the water depths underlying the platform, and the depth of penetration into the well to the horizons of interest. Platform equipment 28 will typically include drawworks, a turntable, generators, instrumentations, controls, and so forth. Control and monitoring systems 30 allow for monitoring all aspects of drilling, completion, workover or any other operations performed, as well as well conditions, such as pressures, production, depths, rates of advance, and so forth.

In accordance with the present disclosure, at least two different tubular stocks are provided and used by the operation, and these may be stored on a deck or other storage location. In FIG. 1 a first of these is designated tubular 1 storage 32, and the second is designated tubular 2 storage. As will be appreciated by those skilled in the art, such tubular products may comprise lengths of pipe with connectors at each end to allow for extended strings to be assembled, typically by screwing one into the other. The two different tubular stocks are used here to allow the operation to balance the technical qualities of each against their costs. That is, one material may be selected for its relative strength but lower cost (e.g., steel), while the other is selected based upon its superior ability to be sheared in case of need, although it may be more costly than the first material. In presently contemplated embodiments, this second tubular stock may comprise titanium alloys, aluminum alloys, but possibly also certain composite materials. As discussed below, the operation judiciously selected which material to use based upon the likelihood that it may be necessary to shear the overall string.

In the illustration of FIG. 1, a first or lower tubular string 36 has been assembled and deployed in the well, and is connected to a second tubular string 38 above, which traverses the earth's surface 20. A further third tubular string 40 has been assembled and connected above the second tubular string and extends to the platform. In practice, the first and third tubular strings may be made of the first tubular material while the second tubular string is made of the second tubular material. The strings may comprise any suitable length of tubular products, and these will depend upon a number of factors, but typically the location of the horizon of interest (e.g., its depth or for wells having off-vertical sections, the distance to the location of interest), the depth of the water, and the anticipated location of potentially problematic regions where it may be necessary to shear the string. In the illustration of FIG. 1, a tool 42 of some sort is located at the bottom of (or along) the string. In drilling operations, for example, this tool will include a drill bit, although those skilled in the art will recognize that many different tools may be used, including those used for instrumentation, evaluation, completion, production, reworking of sections of the well, and so forth.

To allow the string to be sheared in case of need, a blow out preventer 44 is located, typically at the earth's surface 20, and possibly in conjunction with other equipment, such as hydraulic systems, instrumentation, valving, and so forth. Control and monitoring components or systems 46 (including a BOP control system) will typically be associated with the blow out preventer (BOP) to allow for actuation when needed. Those skilled in the art will recognize that such equipment typically provides shear blades that are in generally opposed positions and can be urged towards one by strong hydraulic rams once the BOP is actuated. Actuation of the BOP is an unusual but critical event, and is typically performed only when well conditions absolutely necessitate it, such as when excessive pressures are detected from the well. For safety reasons it is important that the BOP reliably shear the string to seal the well.

It has been found that certain tubular materials used in wells may not be effectively sheared by such BOPs, however. In particular conventional steel tubulars used in oil and gas wells are difficult or impossible to shear under the forces available from BOPs. This is particularly true of thick walled tubulars (e.g., 4 to 7 inches in outer diameter with thick walls, such as on the order of 1 inch or more in thickness). But it has been found that other materials may be much more favorable to shearing, and can be used in specific locations in the tubular string, particularly through the BOP, and particularly when horizons or regions are being accessed that have a higher likelihood of requiring actuation of the BOP. In the illustrated embodiment, the first tubular string 36 extends over a first length 48, the second tubular string 38 extends over a second length 50, and the upper or third tubular string 40 extends over a third length 52. It is contemplated that different tubular strings or sections will be used because the lower and upper strings may be less expensive (e.g., conventional steels), while the second string or section, while more expensive, will be selected to have material properties that render it much more likely to be sheared by the BOP. That is, there may not be a need for this material in the well or through the depth of water below the platform, but for at least that length of the string that is likely to be moved through the BOP during operation, and particularly during accessing those regions of higher risk of excessive pressure events, the more shearable material is used.

It should be noted that the upper or third tubular string may be the same material as the second tubular string, but in many cases this will not be economical owing to the relatively higher cost of the second material, particularly in deep water and where the upper tubular string is not likely ever to traverse the BOP.

Figure 2:
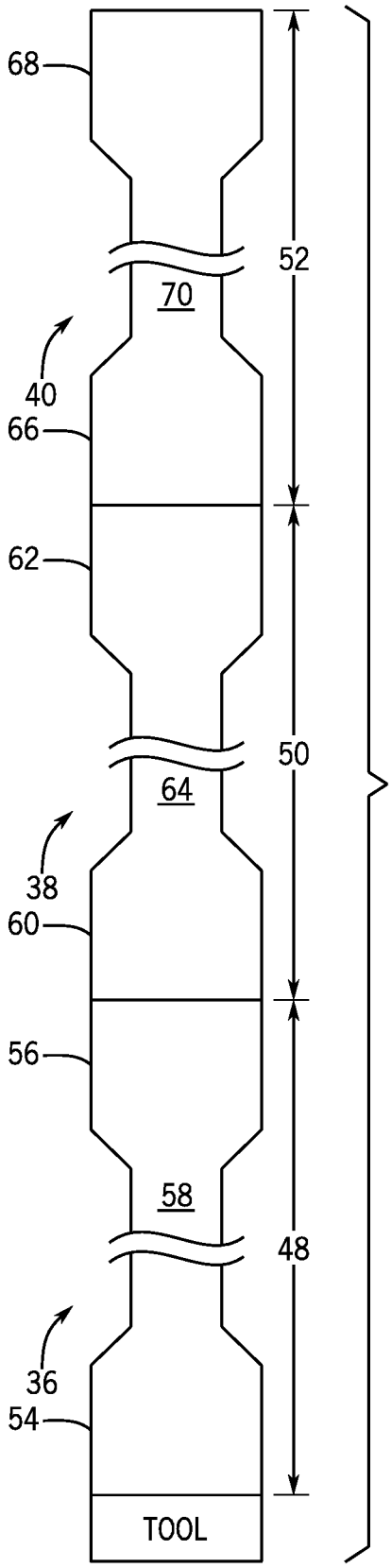
FIG. 2 is a diagrammatical representation of a sections of a tubular string extending from a platform or vessel to the location of a well, and into the well to a horizon of interest.

By way of example, it is presently contemplated that the first or lower tubular string may be made of conventional steel tubular material. The third tubular string may be made of the same or material, but in some cases of a lower wall thickness. The second tubular string may be made of materials that are more easily sheared, such as titanium alloys, aluminum alloys, or composite materials. The strings are assembled as illustrated generally in FIG. 2. The lower tubular string 36 is first assembled, typically with the tool attached at its lower end. The string will comprise multiple lengths of pipe, tubing, or any suitable tubular section 58 with connectors 54 and 56 added to or formed at each end. Here again, the assembled length 48 is selected so that the entire string will access the one or more horizons of interest, but with the first tubular string still always below the BOP.

This length will typically be determined by well engineers based upon knowledge of the underground formations, testing, instrument readings, and so forth. It may comprise, for example, many sections of standard length (e.g., 40 foot sections). The second tubular string 38 similarly comprises multiple sections 64 each having connectors 60 and 62. The length 50 of this assembly will be selected so that during movement of the entire string, the second string 38 is always in the BOP, and particularly when regions are accessed in which it is more likely that the BOP will be called into play. The upper tubular string 40 similarly comprises multiple section 70 with connectors 66 and 68 along its length 52.

The materials of each string may be designed or selected to provide required tensile strengths, internal pressure ratings, and end thread connections to allow for ready assembly and servicing of the well in the particular conditions then present, and to withstand tensile and compressive loading on the string (e.g., the weight of a completion workover riser). The materials may, of course, be prepared, heat treated, and so forth, to enhance their strength and material properties (e.g., tensile and hoop strengths). Moreover, any suitable length of the second string may be used, such as lengths as short as 10 or 20 feet to extended lengths of hundreds or thousands of feet. It may be noted, too, that in certain applications the more easily shearable second tubular string disclosed here may be considered a "shear joint" that may supplement or replace a conventional shear joint, such as in subsea test tree applications for well completion and reworking. Particular applications may include, for example, not only for direct inclusion into strings used in drilling, completion and re-working, but also use with wireline or slickline tools for well intervention, running logging tools, installing plugs (e.g., completion or subsea wellheads). Further, versions of the proposed second, more easily shearable strings may be incorporated into these tool strings, such as within heavy-walled section components such as "sinker bars" or similar devices that have thick metallic cross-sections and are difficult to shear by shear rams when needed to create a well-barrier against release of fluids (e.g., hydrocarbons).

Figure 3:
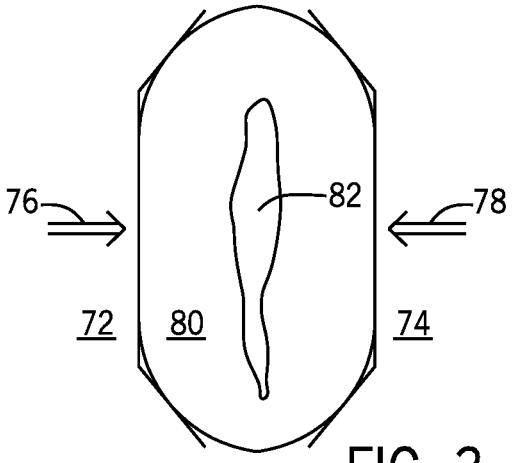
FIG. 3 PRIOR ART
FIG. 3 is a diagrammatical representation of an exemplary tubular that has been crushed but not sheared as might occur with prior art technologies.

As noted above, it has been found that conventional tubular materials used in wells may not be effectively sheared by BOPs under the forces available. FIG. 3 illustrates this diagrammatically. Upon actuation of the BOP, jaws or blades 72 and 74 are urged towards one another under considerable force, as indicated by arrows 72 and 74. The jaws may be offset vertically from one another (that is, perpendicular to the view of FIG. 3) to promote shearing of the tubular string. However, it has been found that conventional materials may only be crushed and not sheared, with the walls 80 of the tubular being deformed. In fact, a passageway 82 may even remain open through the tubular that can permit the escape of high pressure fluids. And once the BOP is actuated and fails to fully shear the tubular section, it may be impossible to re-actuate the equipment or to thereafter fully shear the section. It may be noted that in practice, more than one set of jaws may be provided, and these may be located in upper and lower locations. This may allow for ensuring that the tubular section rather than the connectors are contacted by at least one set of jaws.

Figure 4:
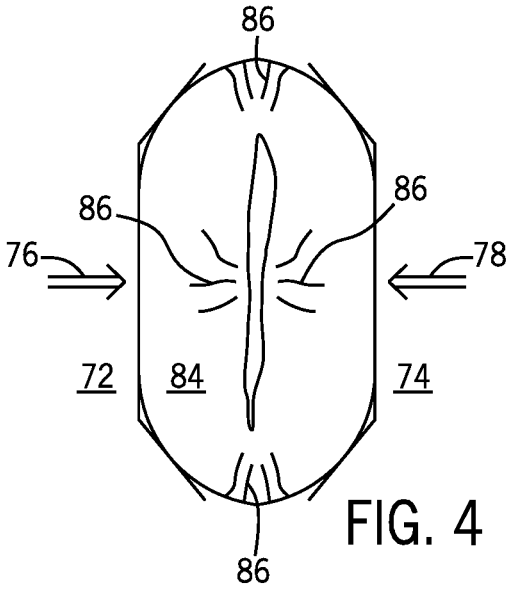
FIG. 4 is a similar diagrammatical representation of an exemplary tubular in accordance with the disclosure, illustrating initiation of fracture before severing.

FIG. 4 is a diagrammatical representation of a tubular made of a material contemplated for the second string discussed above during initiation of shearing. Owing to the unique material properties, which as significantly different from those of conventional well tubulars, under the forces 76 and 78 of the BOP jaws 72 and 74, the walls 84 of these tubulars are deformed, and cracking is initiated, as indicated by reference numeral 86. Energy is effectively stored in the material during deformation, and this energy is released to both initiate and to promote the cracking, resulting in rapid shearing, typically at much lower levels of force than conventional materials.

Figures 5A, 5B, 5C:
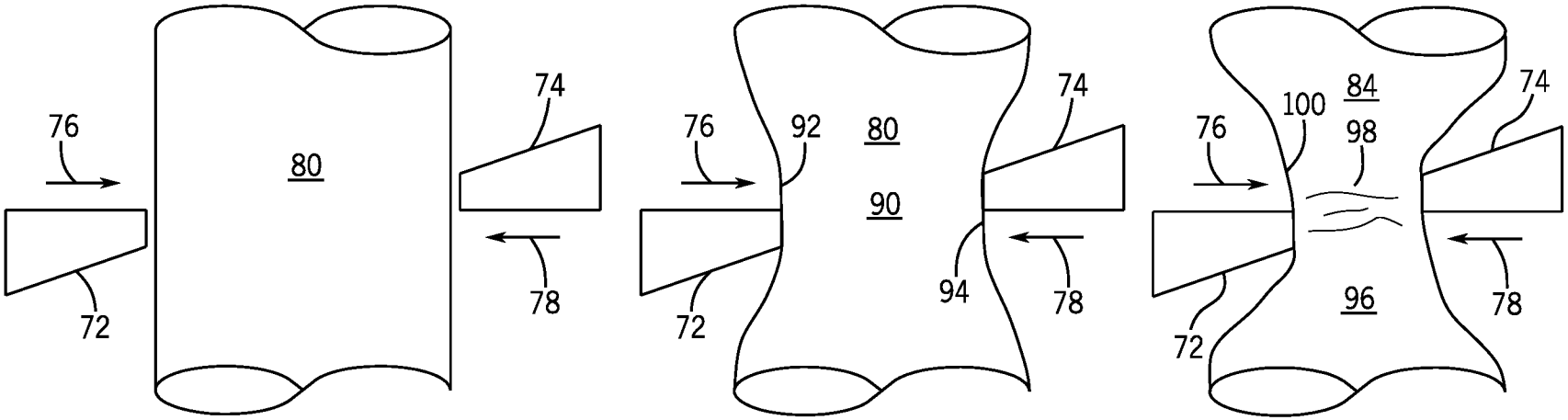
FIG. 5B PRIOR ART
FIG. 5A PRIOR ART
FIGS. 5A-5C are further diagrammatical representations of the behavior of the tubulars of the prior art and that proposed by the present disclosure before and during shearing.

The process of shearing the tubulars is illustrated again in FIGS. 5A-5C. As shown in FIG. 5A, prior to operation of the BOP the jaws 72 and 74 are positioned in generally offset locations on either side of the tubular 80. Forces 74 and 76 are initiated by actuation of the BOP to attempt to shear the material. However, as shown in FIG. 5B, the prior art tubular (typically steel), tends to neck down, as indicated by reference numeral 90, and may fold or form a bulge on either side where the jaws deform the sidewalls, as indicated by reference numerals 92 and 94. In the case of the proposed tubular 84, however, as illustrated in FIG. 5C, under similar or even reduced forces, the jaws 72 and 74 also deform the side wall, as indicated by reference numeral 96. Here, however, cracks are initiated both in locations adjacent to the jaws, and on other ends that are subject to the deformation, as indicated by reference numeral 98. Fracture thus initiates, as indicated by reference numeral 100, and the tubular essentially shatters by release of stored energy.

The material properties believed to be of particular interest in allowing for reliable shearing of the second tubular string include yield and tensile strengths and their relative relationships to one another, modulus of elasticity, fracture toughness, and tendancy, based upon these properties, of cracks to propagate quickly. Regarding, first, the strength of the materials, for steel alloys a typical strength yield strength may be on the order of approximately 150 KSI, although this may range, for example between 135 to 165 KSI yield strength range. Tensile strengths for such steel materials may range typically between 20 to 30 KSI higher than the yield strength. A ratio of yield strength to tensile strength may be, therefore, on the order of 0.8 to 0.85. Titanium alloys suitable for the present techniques, on the other hand, have yield strengths typically on the order of 150 KSI, with typical ranges of 120 to over 170 KSI. The tensile strengths of these materials, however, is only approximately 10 KSI above the yield strength, resulting in a substantially higher ratio of on the order of above 0.90. Similarly, aluminum alloys suitable for use in the present techniques will typically have a yield strength on the order of approximately 58 KSI with ranges of 40 to 75 KSI. Typical tensile strengths would be on the order of approximately 63 KSI with ranges of 46 to 81 KSI, resulting in a difference between the yield strength and the tensile strength of only approximately 6 KSI, and a ratio of yield strength to tensile strength of higher than 0.90. Composites are unique in that they can be manufactured to meet any of the requirements for optimum shearability, with very narrow ranges and differences between the yield strength and the tensile strength.

Regarding the modulus of elasticity, conventional steels used for well tubulars have a modulus typically on the order of 29.5 Mpsi, with typical ranges of 27 to 31 Mpsi. Titanium tubulars contemplated for the present techniques, on the other hand, have a modulus typically on the order of 16.5 million psi, with typical ranges of 13.5 to 17 Mpsi. That is, significantly lower than that of steel tubulars. Aluminum alloy tubulars suitable for the present techniques have a modulus typically on the order of 10 Mpsi. Ranges 9 to 11.5 Mpsi. Suitable composites can be made to have a very low modulus, such as on the order of 5 Mpsi if required.

Regarding the fracture toughness, this property may be defined the ability of a material containing a crack to resist fracture. The value indicates the stress level that would be required for a fracture to occur rapidly. Typical steels used for well tubulars may have a fracture toughness on the order of 100 $KSIin^{-2}$, with ranges of approximately 65 to 150 $KSIin^{-2}$. Titanium tubulars contemplated for the present techniques, on the other hand have fracture toughness valued on the order of approximately 45 $KSIin^{-2}$, with ranges of approximately 35 to 70 $KSIin^{-2}$. Suitable aluminum tubulars have a fracture toughness typically on the order of approximately 35 $KSIin^{-2}$. Here again, composite tubulars may be made to have very low fracture toughness valued, similar to those mentioned for titanium and aluminum alloys.

Finally, regarding tendancy for rapid crack propagation, this may be considered to result from stored energy in the material during deformation, and from the other characteristics discussed above. As noted, the tubulars contemplated for the second tubular string, to be positioned in the BOP, will typically be deformed, but with cracks initiating in multiple locations, such as adjacent to locations that contact the BOP jaws, and in locations approximately 90 degrees from these locations, such as where the material is bent or crushed at opposite sides. Essentially then, owing to the strength values (particularly the relatively smaller difference between the yield strength and the tensile strength), the lower modulus of elasticity, and the lower fracture toughness, the proposed tubulars tend to store significant energy during deformation, that is released to cause very rapid propagation of the initiated cracks. In tests, it has been shown that a titanium tubular tends to virtually shatter under forces significantly lower than those that only resulted in deformation of comparably sized steel tubulars (without actual shearing of the latter).

Regarding the specific materials that may be used, it is believed that typical conventional steel tubulars may be made of an alloy composition corresponding to AISI 4100 and 4300 series alloys. Presently contemplated titanium tubulars may be selected from the so-called Alpha Beta and Beta families. Suitable aluminum tubulars may be selected, for example, from 2000, 6000, and 7000 series. Suitable composites may include carbon fiber compositions.

Based upon these materials, it has been demonstrated in full scale tests that such titanium tubulars are significantly easier to shear. It is believed, for example, that a 6.625 in OD steel tubular in thick wall sections can not be sheared by a BOP with available shear forces. A titanium tubular with similar dimensions was sheared fully with application of much lower forces than those that are not successful in shearing the steel tubular.

Figure 6:
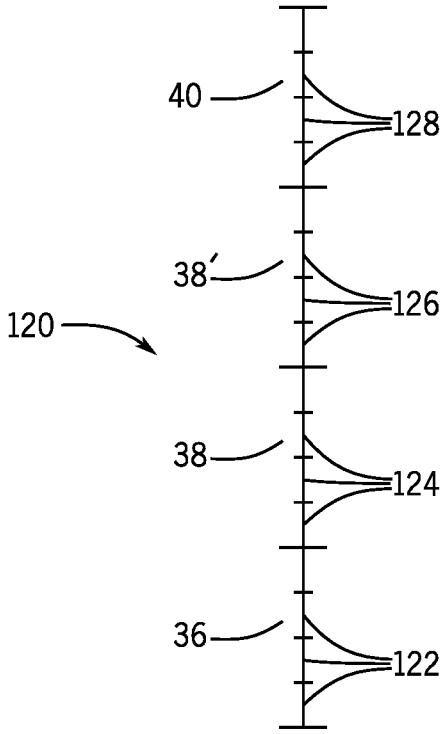
FIGS. 6 and 7 are further diagrams of an exemplary implementation of a sectioned tubular string in accordance with the present disclosure.

As noted above, in many applications the present technique will be used to select a first tubular string that will lie below the BOP during working of the well, particularly in a horizon considered at risk. The second tubular string, comprising the more readily shearable material will be located above the first string, and will normally traverse the BOP, while a third string will be positioned above this second string. Variants on this approach are envisioned, however, as illustrate in FIGS. 6 and 7. In the embodiment of FIG. 6, the tubular string 120 comprises a lower or first string 36 that will be made up of sections 122 that may be conventional steel tubulars. A next string 38, like the second string discussed above, may be made of a different material in sections 124, such as a titanium, aluminum or composite tubular. A further string, noted as 38' maybe assembled above this second tubular, and may be made of yet a different material, albeit one that is more easily sheared than the first material of string 36. Then an upper tubular string 40 may be assembled of sections 128 as discussed above. This arrangement may allow for the use of economically more cost-effective sections (that is, of a lower cost) for portions of the sections 38 and 38', when desired.

Figure 7:
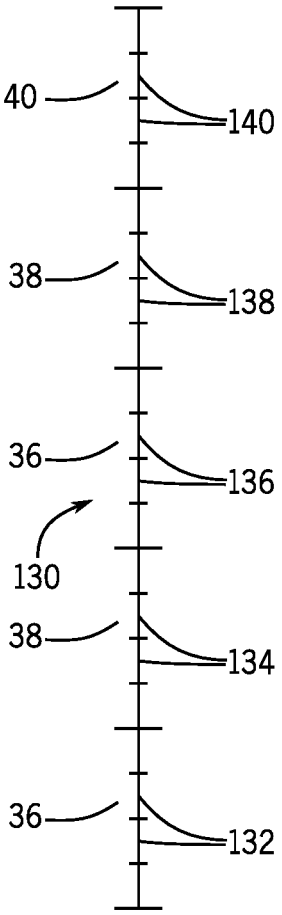

In the case of the string illustrated in FIG. 7, on the other hand, alternating sections of the first and second materials are used. Thus, the first string 36 comprises sections 132, which may be made of conventional steel tubulars. The second string 38 comprises the more easily shearable material in sections 134. Above this string, then, a third tubular similar of the first string is assembled of sections 136. Then above this string, another string 38 of the more easily shearable material is assembled of section 138, followed by an upper string 40 made of sections 140, which again may be a conventional steel tubular. This arrangement may comprise even more alternating sections of conventional materials and more easily shearable materials, with the latter being located so that they lie in the BOP during periods where horizons or sections of the well are being worked that are considered at higher risk of events that may require actuation of the BOP.

Figure 8:
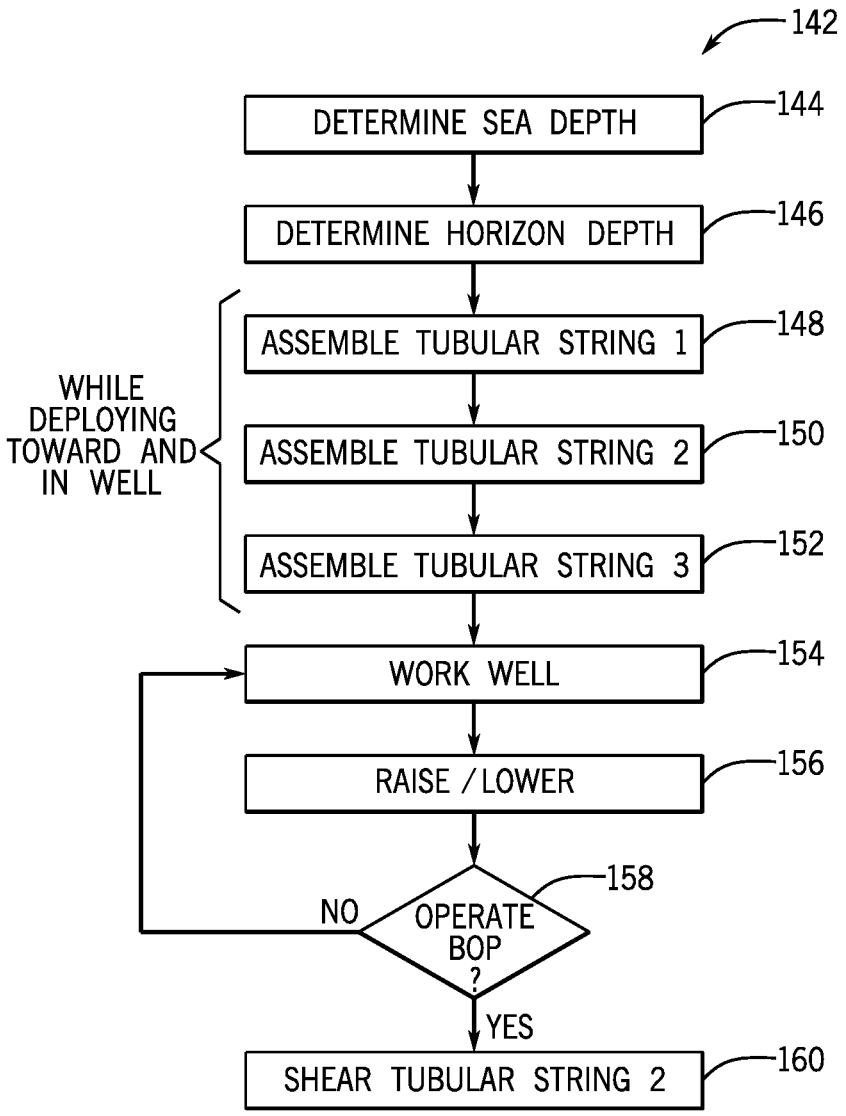
FIG. 8 is a flow chart illustrating exemplary steps in implementation of the present techniques.

FIG. 8 is a flow chart illustrating exemplary logic 142 for performing the method of assembling the tubular strings discussed above, and for working a well with such strings. As indicated by reference numeral 144, in subsea applications the sea depth is determined (that is, the depth between the platform or vessel and the well location). Next, the depth of the well from the earth's surface to the horizon of interest is determined, as indicated at step 146. It should be noted that this step may particularly focus on those locations or horizons at which there is considered an elevated risk of an event that may require shearing of the tubular string. Also, those skilled in the art will recognize that this "depth" may not be a simple vertical depth, but a trajectory distance in the well, which may include vertical and off-vertical sections.

Based upon these parameters, the first tubular string is assembled at step 148. This may be done in a conventional manner during working of the site. During drilling, for example, tools and instrumentation will be used with the tubular string that are suitable for such phases of operation. During later operations, such as completion and workover, other tools will be associated with the tubular string, and many other components may be called upon, depending upon the phase of operation and the tasks being performed. Once the desired length of the first tubular string is assembled and deployed, then, the second tubular string, made of the more easily shearable material, is assembled above the first tubular string, at step 150. Again, the length of this string is selected so that when horizons more at risk are being worked or traversed, only the second tubular string will be located in the BOP. Of course, there are periods during which the first tubular string may be inserted into the well, and withdrawn from the well, but the present focus is on those periods most at risk, and in ensuring that the second tubular string is in the BOP during most or all high risk periods. Thereafter, the third tubular string may be assembled above the second tubular string, as indicated at step 152.

Once assembled and deployed, the tubular string is used to work the well, as indicated at step 154. In particular, the string may be raised and lowered as indicated at step 156, but with the second tubular string always in the BOP during periods of risk of actuation of the BOP. Operations during these steps may be conventional insomuch as the well is drilled, completed, instrumented, reworked, and so forth, while monitoring well parameters, particularly pressures. When the BOP is to be actuated, then, as indicated at block 158, the second tubular string should be in place traversing the BOP, rather than the first or third strings. When actuated, the BOP acts to shear the second tubular string, as indicated by reference numeral 160.

Figure 9:
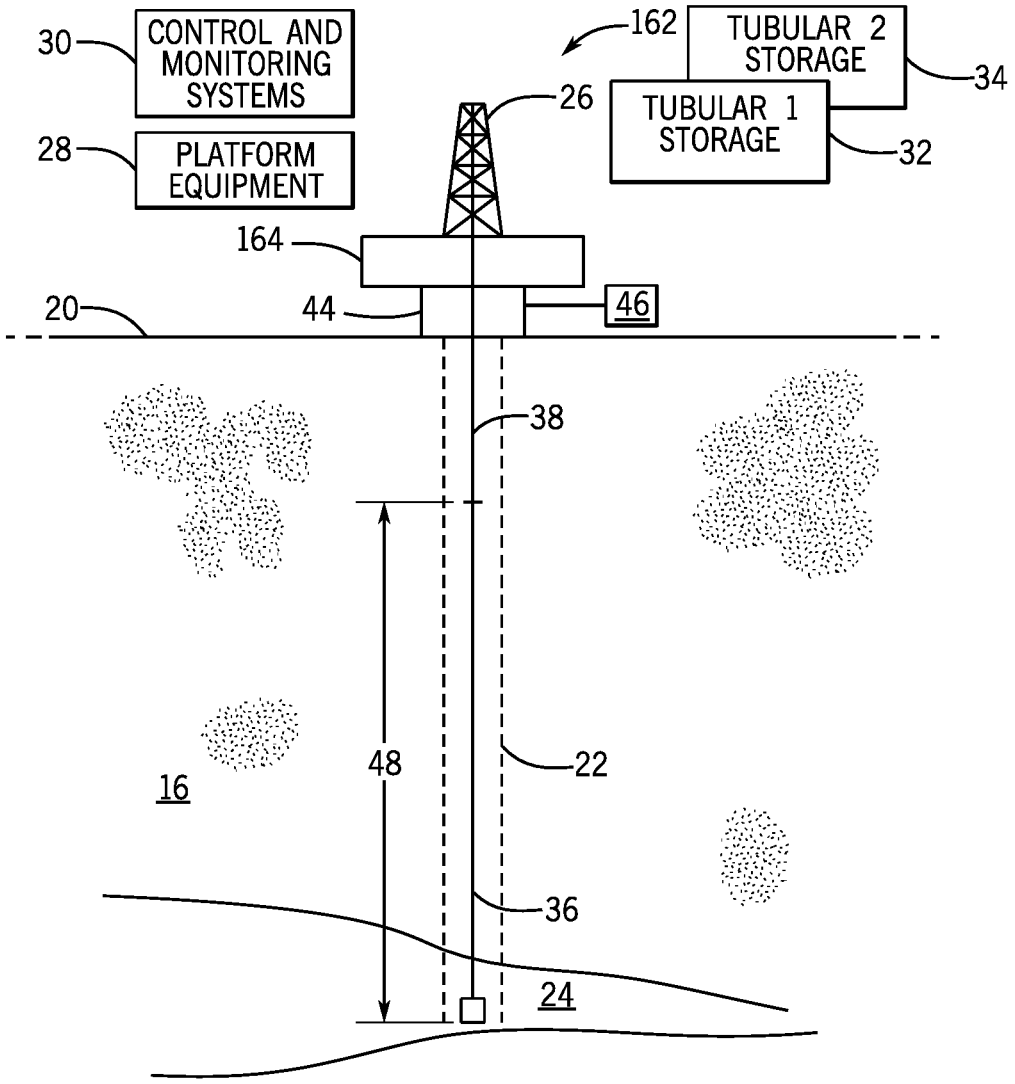
FIG. 9 is a diagrammatical representation of a land-based well operation that may utilize aspects of the present techniques.

It should be noted that the foregoing discussion has focused on subsea wells, and these are considered to be of particular interest in the present technique because an extended length of relatively lower cost, but less easily shearable material may be used in that portion of the tubular string that simply accesses the well though the depth of the sea (that is, the upper tubular string). However, the techniques may also be used for land-based applications. FIG. 9 illustrates this option diagrammatically. In a land-based well operation 162, many of the components and systems may be similar to those illustrated in FIG. 1 and discussed above. In this case, however, a rig 164 is typically used, in conjunction with a BOP 44 and its associated systems 46. Here, however, a first or lower tubular string 36 is used over a length 48 in the well to access one or more horizons of interest 24. When this string is in place, and particularly when it is believed that a horizon or location of elevated risk of operation of the BOP is being accessed or traversed, the second tubular string 38 may be assembled and positioned above the first tubular string. Once in place, the second tubular string, which is again made of a more easily shearable material, traverses the BOP so that in case of need, this second string can be sheared rather than attempting to shear the lower string 36.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for accessing subterranean horizons, comprising: assembling a first tubular string comprising multiple sections of first tubular material to extend beneath a subterranean level to a horizon of interest; assembling a second tubular string comprising multiple sections of a second tubular material attached above the first tubular string, the second tubular string extending along a length that will traverse a blow out preventer during accessing of the horizon of interest; and assembling a third tubular string comprising multiple sections of the first tubular material attached above the second tubular string; wherein during accessing the horizon of interest, except during placement and removal of the first tubular string, only the second tubular string traverses the blowout preventer; and wherein the second tubular string comprises a single wall material, and the first tubular material has a first difference between yield strength and tensile strength thereof, and the second tubular material has a second difference between yield strength and tensile strength thereof, the second difference being less than the first difference, wherein the second tubular string is made of a titanium alloy or aluminum alloy, wherein the first and the third tubular strings are made of a steel alloy.

2. The method of claim 1, wherein the first tubular material has a ratio of yield strength to tensile strength of at most approximately 0.85 and the second tubular material has a ratio of yield strength to tensile strength of at least approximately 0.90, whereby the second tubular material is more favorable to shear by action of the blow out preventer than the first tubular material.

3. The method of claim 2, comprising assembling the first, second, and third tubular strings in series as the tubular strings are deployed in a well.

4. The method of claim 2, wherein, except during placement and removal of the first tubular string, the first tubular string is deployed underground, and the third tubular string is deployed underwater between the sea surface and the second tubular string.

5. The method of claim 2, wherein the second tubular string is characterized by a yield strength to tensile strength ratio of at least approximately 0.9, a modulus of elasticity of at most approximately 17 Mpsi, and a fracture toughness of at most approximately 45 $KSIin^{-2}$.

6. A method for accessing subterranean horizons, comprising: assembling a first tubular string comprising multiple sections of a first tubular material to extend only beneath a subterranean level to a horizon of interest except during placement and removal of the first tubular string; assembling a second tubular string comprising multiple sections of a second tubular material attached above the first tubular string, the second tubular string extending along a length that will traverse a blowout preventer during accessing of the horizon of interest; and assembling a third tubular string comprising multiple sections of the first tubular material attached above the second tubular string to extend only above the blow out preventer in a subsea environment; wherein the second tubular string comprises a single wall material, and the first tubular material has a first difference between yield strength and tensile strength thereof, and the second tubular material has a second difference between yield strength and tensile strength thereof, the second difference being less than the first difference, wherein the second tubular string is made of a titanium alloy or aluminum alloy, wherein the first and the third tubular strings are made of a steel alloy.

7. The method of claim 6, wherein the first tubular material has a ratio of yield strength to tensile strength of at most approximately 0.85 and the second tubular material has a ratio of yield strength to tensile strength of at least approximately 0.90, whereby the second tubular material is more favorable to shear by action of the blow out preventer than the first tubular material.

8. The method of claim 6, comprising assembling the first, second, and third tubular strings in series as the tubular strings are deployed in a well.

9. A tubular string comprising: a first tubular string comprising multiple sections of first tubular material extending only beneath a subterranean level to a horizon of interest except during placement and removal of the first tubular string; a second tubular string comprising multiple sections of second tubular material attached above the first tubular string, the second tubular string extending along a length that will traverse a blow out preventer during accessing of the horizon of interest; and a third tubular string comprising multiple sections of first tubular material attached above the second tubular string to extend only above the blow out preventer in a subsea environment; wherein the second tubular string comprises a single wall material, and the first tubular material has a first difference between yield strength and tensile strength thereof, and the second tubular material has a second difference between yield strength and tensile strength thereof, the second difference being less than the first difference, wherein the second tubular string is made of a titanium alloy or aluminum alloy, wherein the first and the third tubular strings are made of a steel alloy.

10. The tubular string of claim 9, wherein the first tubular material has a ratio of yield strength to tensile strength of at most approximately 0.85 and the second tubular material has a ratio of yield strength to tensile strength of at least approximately 0.90, whereby the second tubular material is more favorable to shear by action of the blow out preventer than the first tubular material.

11. The tubular string of claim 9, wherein the second tubular string is characterized by a yield strength to tensile strength ratio of at least approximately 0.9, a modulus of elasticity of at most approximately 17 Mpsi, and a fracture toughness of at most approximately 45 $KSIin^{-2}$.

* * * * *